United States Patent [19]

Goldstein et al.

[11] Patent Number: 5,018,786

[45] Date of Patent: May 28, 1991

[54] ERGONOMIC ADJUSTABLE CHAIR AND METHOD

[76] Inventors: Glenn A. Goldstein, 1400 E. 46th St., Brooklyn, N.Y. 11234; Clifford M. Gross, 732 Gerald Ct., Brooklyn, N.Y. 11235

[21] Appl. No.: 13,171

[22] Filed: Feb. 10, 1987

Related U.S. Application Data

[63] Continuation of Ser. No. 550,162, Nov. 9, 1983, abandoned.

[51] Int. Cl.[5] ..... A47C 7/46

[52] U.S. Cl. ..... 297/284; 297/460

[58] Field of Search ..... 297/284

[56] References Cited

U.S. PATENT DOCUMENTS

| | | | |
|---|---|---|---|
| 3,093,413 | 6/1963 | Chancellor, Jr. | 297/284 |
| 3,990,742 | 11/1976 | Glass et al. | 297/284 |
| 4,339,150 | 7/1982 | McNamara et al. | 297/284 |

FOREIGN PATENT DOCUMENTS

| | | | |
|---|---|---|---|
| 26668 | 4/1981 | European Pat. Off. | 297/284 |
| 943124 | 11/1963 | United Kingdom | 297/284 |

*Primary Examiner*—Peter R. Brown

*Attorney, Agent, or Firm*—Jones, Tullar & Cooper

[57] ABSTRACT

An adjustable chair having a back rest and a contour adjusting mechanism for adjusting the contour of the occupant engaging surface of the back rest. The contour adjustment mechanism comprises a series of longitudinally spaced adjustment linkages which also form part of the back rest. The contour adjustment includes adjustments for at least spinal curvature of an individual. For this purpose a gauge may be provided for pre-calculating the individual's back curvature, and this pre-calculation used in conjunction with the adjustment mechanisms to effect the desired adjustment of the occupant engaging surface.

10 Claims, 2 Drawing Sheets

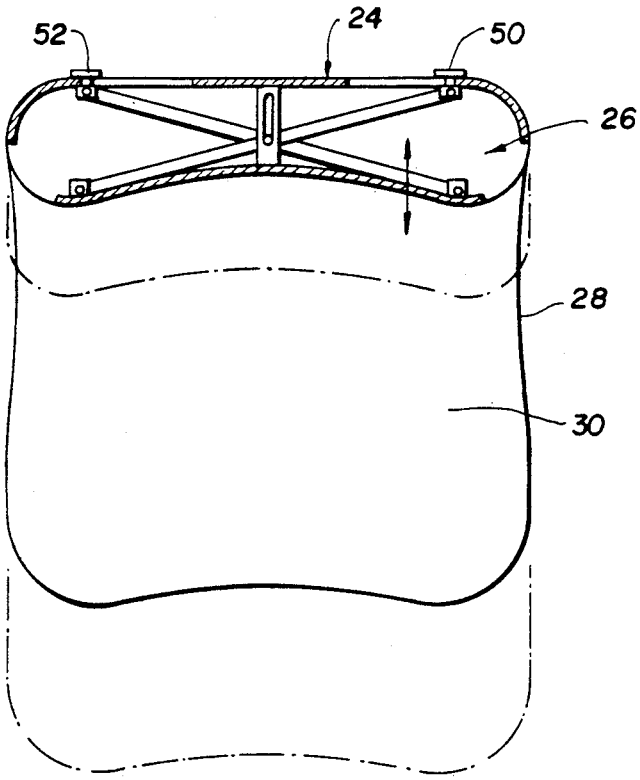
FIG. 3
FIG. 5
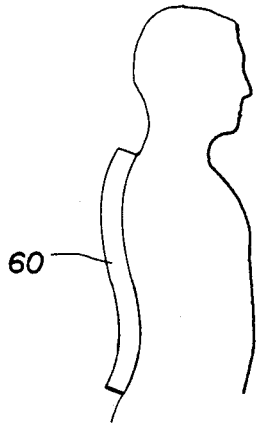
FIG. 4
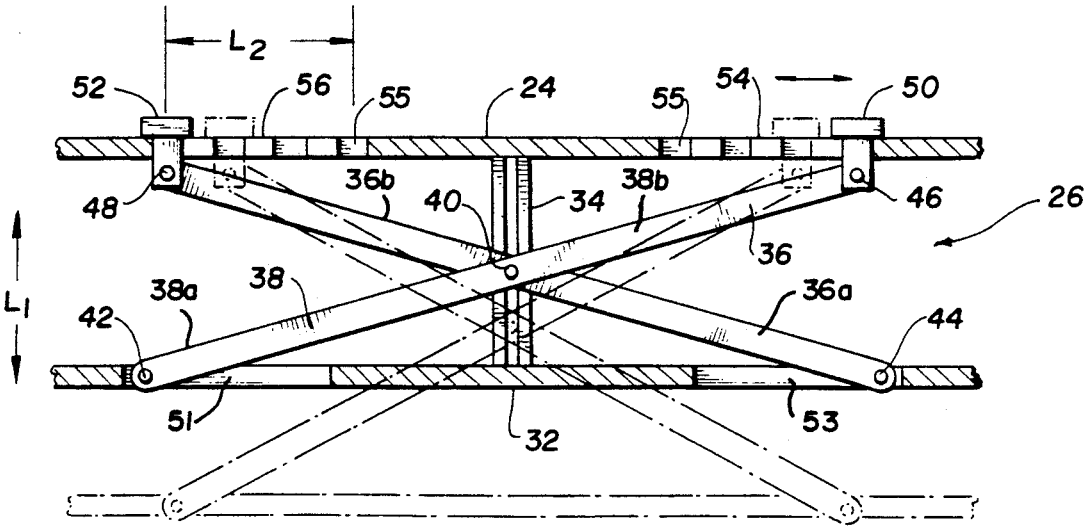

ERGONOMIC ADJUSTABLE CHAIR AND METHOD

This is a continuation of co-pending application Ser. No. 550,162 file on Nov. 9, 1983, now abandoned.

BACKGROUND OF THE INVENTION

1. Field of the Invention

The present invention relates generally to chairs and particularly to chairs with back rests which are adjustable to individual spinal curvatures.

2. Prior Art

In the human population the range of spinal length and curvature is, for practical purposes, infinite. Also, it is clear that the pressure exerted on an individual's back when in a seated position by the seat's back rest can produce discomfort and even injury to, for example, the lower back region, due to lack of conformity between the individual's spinal curvature and the curvature of the seat's back rest. There has always been, therefore, a need for a chair with an adjustable back rest to accomodate to some degree this variations in spinal length and curvature.

In fact, chairs with back rests which are adjustable in contour are known. See, for example, U.S. Pat. Nos. 2,549,902; 2,550,831; 3,288,525; 4,313,657; and 4,347,840. Of the chairs disclosed in these patents, that disclosed in 2,549,902 has perhaps the greatest degree of adaptability due to the provision of the rows of individually adjustable heads each of which covers a small area of the back covering of the chair. The individual adjustment allows for a variety of contours. Due to the limited area of application of the individually adjustable heads, however, the necessary support between adjacent heads is unsatisfactory since the covering material of the back rest, which is necessarily flexible, does not ordinarily have sufficient inherent stiffness to effect a proper load distribution of the load applied by the individual heads between adjacent heads, resulting in "soft-spots". If the material is designed to have necessary stiffness, then the effect of the loads applied by the individually adjustable heads for contour control is correspondingly dimished or even lost. Moreover, the individual heads tend to produce a relatively concentrated load, the cumlative effect of which is to produce occupant discomfort.

The theoretical rationale for maintaining an individual's standing spinal curvature, i.e., lordosis and kyphosis during sitting is presented by Anderson et al, 1979 *Spine*, Vol. 4, Number 1, in their paper delineating spinal shape. Using X-ray analysis they quantified the mean reduction in lumbar lordosis during sitting as 38°. Therefore, an effective sitting modality should re-establish the existing lumbar lordosis. This would have the benefit of reducing the tensile stresses in the posterior annulus fibers during sitting. Futhermore, it is essential that the apex of the spinal curvature coincide with the apex of the seat curvatures to reinstitute the standing curvatures with a minimum of stress concentration. This necessitates longitudinal and transverse plane adjustments of the backrest position.

There exists, therefore, a need for a chair with a back rest whose contour can be adjusted to suit the particular needs or posture of the occupant such that a substantially uniform load distribution without any effective "soft-spots" results.

This would provide maximum distribution of stress over the entire length of the spine, thereby reducing compressive force within the intervertebral disc and resulting strain in the annulus fibrosis.

OBJECTS AND SUMMARY OF THE INVENTION

An object of the present invention, therefore, is to provide the existing state-of-the-art with a chair having a back rest which is uniquely constructed and uniquely adjustable as to contour.

A related object of the present invention is to provide the existing state-of-the-art with a chair such as noted in the previously stated object the back rest of which can be adjusted to substantially match the overall curvature of an individual's back.

Another related object of the present invention is to provide the existing state-of-the-art with a chair such as noted in the first stated object, the back rest of which can be adjusted to substantially match the spinal curvature of an individual's back.

Another object of the present invention is to provide the existing state-of-the-art with a chair such as noted in the previously stated objects which can also be adjusted for varying femur lengths.

Another object of the present invention is to provide the existing state-of-the-art with a chair such as noted in the first three stated objects in which the back rest can also be adjusted in height.

Another object of the present invention is to provide the existing state-of-the-art with a chair such as noted in the first three stated objects which can also have the back rest independently inclined relative to the seat or inclined together with the seat.

Another object of the present invention is to provide the existing state-of-the-art with a chair such as noted in all the previously stated objects.

Another object of the present invention which is associated with at least the first three stated objects provides the existing state-of-the-art with a method according to which the overall curvature of an individual's back can be reproduced.

Another object of the present invention which is related to the previously stated object provides the existing state-of-the-art with a method according to which the spinal curvature of an individual's back can be reproduced.

To summarize: The chair according to the present invention includes a back rest having a unique mechanism which can be adjusted, either manually or automatically, quickly, simply, effectively, and without the need to assemble or disassemble any parts. The mechanism, in all its adjusted positions, provides at least spinal curvature conformity for the indivdual desirous of using the chair. It also imparts a more uniform loading to the flexible accupant engaging surface and serves as part of the structural support for the flexible occupant engaging surface.

A gauge is proposed which can be manipulated to reproduce spinal curvature. The gauge can be used to assist the individual user of the chair to effect the desired adjustments to the noted unique mechanism for adjusting the back rest of the chair. The invention also contemplates a gauge which can be manipulated to reproduce the overall curvature of an individual's back. Such a gauge would be useful where noted unique mechanism is designed for overall back rest adjustment, i.e., longitudinally (spinal) as well as transverse thereto.

The chair also provides for seat adjustment for varying femur lengths, back rest height adjustment (this is in addition to the previously noted curvature adjustment), seat and back rest inclination control, and scrolled seat edge for reduction of compressional ischemia of the thigh.

BRIEF DESCRIPTION OF THE DRAWINGS

Five figures have been selected to illustrate the preferred embodiment and best mode of the present invention. These figures, while schematic in some respects, are sufficiently, detailed to inform those skilled in the art. Included are:

FIG. 3, which is a top view of the back rest illustrating details of the unique back rest adjustment mechanism.

FIG. 4, which is a plane view of one segment of the unique back rest adjustment mechanism. An adjusted position is shown in dashed lines.

FIG. 5, which is a schematic view illustrating the use of the spinal gauge according to the present invention.

DESCRIPTION OF THE PREFERRED EMBODIMENT

Figure 1:
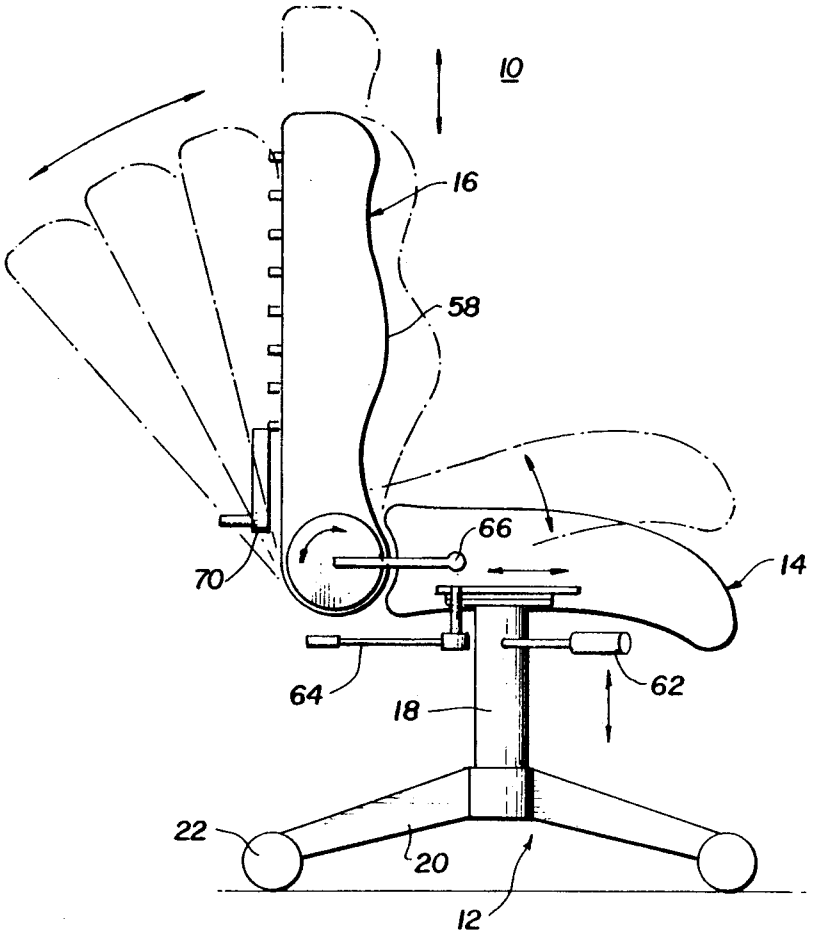
FIG. 1, which is a side elevational view of a chair embodying the features according to the present invention. Various inclined positions of the back rest and seat are shown in dashed lines as well as an extended position of the back rest and seat.

To demonstrate the invention in more concrete terms, a preferred embodiment has been illustrated in FIGS. 1-5, In FIG. 1, there is depicted an adjustable chair 10 including a base structure 12, a seat structure 14 and a base rest 16. The base structure 12 includes a hydraulic cylinder 18 supported in a five leg star base 20 having coasters 22 at their free ends which may have foot operated locks for stability on smooth surfaces. Arm rests, not shown, may be included connected to each side of the seat structure. These arm rests will be adjustable for height and transverse motion.

With respect to FIGS. 1-4, it can be seen that the back rest 16 includes a frame 24, a contour adjustment mechanism 26 and a flexible cover 28 which defines an occupant engaging surface 30. The flexible cover 28 is supported by the contour adjustment mechanism 26 and the frame 24 and comprises a typical padded type of construction.

Figure 2:
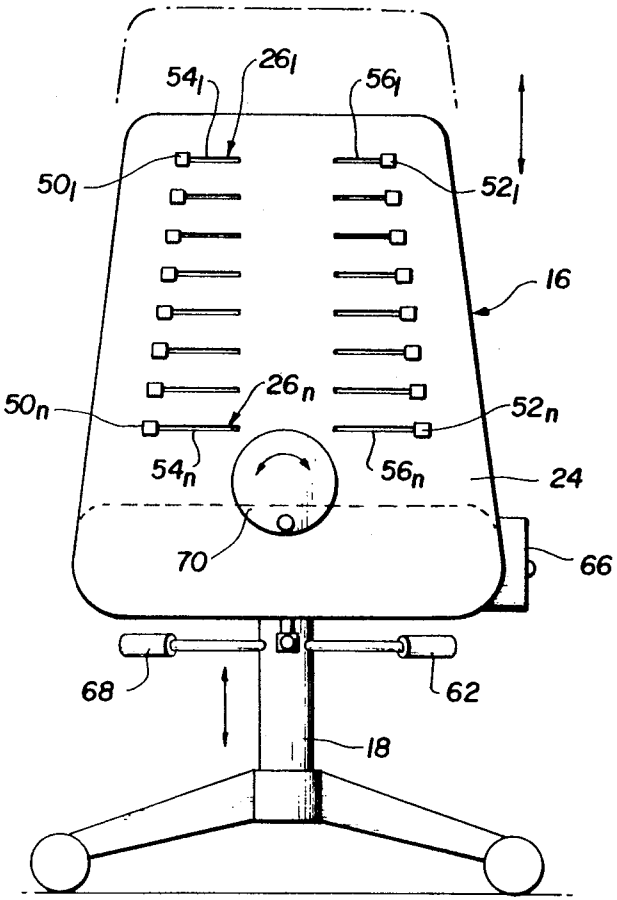
FIG. 2, which is a rear elevational view of the chair shown in FIG. 1, illustrating the adjustment levers for the back rest adjustment mechanism. An extended position of the back rest is also shown in dashed lines.

As shown in FIG. 2, there are an arbitrary number of parallel spaced, longitudinally arranged contour adjustment mechanism 26, identified as $26_1$-$26_n$. The exact number of contour adjustment mechanism $26_n$ is dictated primarily by one's desire for exactness. The more such mechanisms, the more exact can the reproduction be of an individual's back contour. While this is so, we have found that to include a maximum number of mechanisms, i.e., a number such that adjacent mechanisms are practically in engagement, is not necessary since the material of the flexible cover 28 is not so flexible as to respond to such close arrangement of mechanisms. We have found that an optimum range is between eight to ten mechanisms.

Each mechanism 26, has the adjustment linkage configuration shown in FIG. 4. Included as part of the adjustment linkage is a front beam member 32 which serves as the flexible cover engaging memver, and an assembly which serves for adjusting the relative position of the front beam member 32 with respect to the frame 24. The assembly includes a track 34, a first cross beam member 36, a second cross beam member 38, and a pin 40 which connects both cross beam members and serves as a pivot pin for the relative pivotal movement of the cross beam members. For this purpose the pin 40 extends into and is displaced along the track 34. The cross beam members 36 and 38 comprise a pair of linkage members which are pivotably connected at 42 and 44 to the front beam member 32, and pivotably connected at 46 and 48 to slide control levers 50 and 52, respectively. The slide control levers 50 abd 52 are mounted in slots in frame 24. These slots form 54 and 56 for the levers 50 and 52, respectively. The levers 50 and 52 move laterally along their tracks 54 and 56 each of which contain a position graticule for positively retaining the levers in their displaced position. The graticule comprises a retaining apparatus including a series of parallel grooves 55 formed in at least one surface of the tracks, and the levers 50 and 52 are inserted into and out of engagement with the grooves to define the various displaced positions of the levers. The levers 50 and 52 can be dimensioned to fit into the grooves 55 so that a frictional retention is achieved. Alternately, the grooves 55 can be provided with any known detent mechanism for positively retaining the levers. In this way, the various adjusted positions of the levers can be securely maintained.

The front beam members 32 are substantially transverse coextensive with the flexible cover, i.e., the distance between connections 42 and 44 is substantially equal to the transvers distance of the flexible cover at that same plane. According to one variant of the present invention, the front beam members 32 are rigid and are displaceable through a predetermined distance from the track 34, which serves as a stop for the front beam member, outwardly thereof. To displace the front beam member 32 from its stop position as shown in FIG. 4, both slide control levers are displaced along their tracks 54,56, respectively, toward the track 34. By differentially adjusting the displacement of the various front beam members 32 a different contour 58 (FIG. 1) can be produced, and this contour can be the reproduction of the spinal curvature of an individual. The maximum displacement of the front beam members 32 is designated in FIG. 4 as $L_1$. With this displacement, the pin 40 is retained in the track 34 for the entire range of displacement of its front beam memeber. The maximum displacement $L_1$ is proportional to the maximum displacement $L_2$ of the levers 50 and 52.

According to another variant of the present invention, the front beam members 32 are deflectable transversely so that connections 42 and 44 are not always retained in the same transverse plane. For this purpose the slide control levers 50 and 52 are differentially displaced in their respective tracks 54 and 56 toward the track 34 and the front beam members 32 are laterally deformable, i.e., they are resilient and can be bent laterally. Also for this purpose the cross beams 36 and 38, according to one embodiment, no longer share a common pivot pin 40. Instead, separate pivot pins will be necessary. For example, the cross beam 36 can be provided with a pivot pin which is displaceable in the top portion of track 34, while the cross beam 38 can be provided with a pivot pin which extends upwardly into the track 34 and is displaceable in the bottom portion thereof. The two pins are then freely displaceable without interference. According to another embodiment, the cross beams 36 and 38 can be constructed as telescoping beams which are adjustable along their length. With this construction, the beams 36 and 38 will comprise portions 36*a*, 36*b* and 38*a*, 38*b* which are, for example, spring biased outwardly, the springs not being shown. With this embodiment, the cross beams can share a common pivot pin. According to this variant of the invention, contour control in both longitudinal (spinal) and transverse directions is possible, i.e., overall control is therefore possible.

According to another feature of the present invention contour adjustments can be pre-calculated by the use of a gauge 60 (FIG. 5). The gauge 60 is deformable and can be placed against the back of the indivdual where it will be deformed to correspond to, for example, the individual's spinal curvature. For this purpose the gauge 60 need only be a narrow strip. If an overall curvature is desired, the gauge 60 would comprise a sheet with both longitudinal and transverse extent sufficient to cover the individual's back. Once the gauge is deformed to the desired curvature, it is placed against the occupant engaging surface 30 and the contour of this surface is adjusted by the various contour adjustment mechanisms 26. This gauge can be made of any appropriate biphasic material that allows for ease of deformation yet insures that the deformed shape will be retained for the purpose of effecting the necessary contour control.

In addition to the contour control, the chair of the present invention features a number of other adjustment possibilities. The seat 14 can be adjusted in height by extending the cylinder 18 which, for example, can be a pneumatic cylinder. The seat 14 can be tilted as can be the back rest 16 and it can be extended as can the back rest 16. Also, the depth of the seat can be adjusted. The controls for producing these adjustments are known and do not form a part of this invention. They are noted here for the purpose of rendering the description complete. Associated with these controls are levers which allow for manual adjustment. These are lever 62 which allows for seat height adjustment; lever 64 which allows for seat depth adjustment; lever 66 which allows for seat back tilt adjustment; lever 68 (FIG. 2) which allows for seat and back rest tilt adjustment; and lever 70 which allows for back rest height adjustment.

While these adjustments are effected manually by control of levers, it should be noted that automatic control in the form of servomotors, for example, could also be used. In additon, it should be noted that the slide control levers can be automatically controlled as well by, for example, stepping motors which could drive a worm gear assembly or an equivalent mechanism to move the slide control levers independently.

The seat 14 can have a scrolled configuration for relieving thigh stress. This feature is also known.

The chair thus described represents a typical secretarial type of chair. The invention has application, however, to many other types of chairs. For example: aircraft pilot and passenger seats; automobile and truck seats; railroad car seats, etc. In each application, an optimum number of contour adjustment mechanism 26 can be determined and provided. For example, for typical executive chair with a 3 foot high back rest, it was determined that a number of contour adjustment mechanisms in excess of 24 was needed.

What is claimed is:

1. An adjustable chair comprising:

a base structure;

a seat structure mounted to the base structure;

a frame structure connected to the seat structure;

a contour adjustment mechanism having a longitudinal and tranverse extent relative to said frame structure, said contour adjustment mechanism comprising a plurality of longitudinally spaced adjustment linkages mounted to the frame structure, the number and transverse extent of the adjustment linkages defining said longitudinal and transverse extent of said contour adjustment mechanism; and a flexible cover mounted to the plurality of adjustment linkages, said flexible cover providing an occupant engaging surface having a longitudinal and transverse extent substantially coextensive with the longitudinal and transverse extent of the contour adjustment mechanism, and said frame structure, plurality of adjustment linkages and flexible cover comprising a back rest, each adjustment linkage comprising:

(i) a flexible cover engaging member which is substantially transverse coextensive with the occupant engaging surface of said flexible cover; and (ii) means mounted to the frame structure for adjusting the relative position of the flexible cover engaging member with respect to said frame structure, and thereby the relative position of the occupant engaging surface of said flexible cover associated therewith, whereby the differential adjustment of the plurality of adjustment linkages adjusts the contour of the occupant engaging surface to conform to at least the spinal curvature of an occupant.

2. The adjustable chair as defined in claim 1, wherein the means for adjusting that relative position of the flexible cover engaging member comprises: a track defining member connected to the frame structure; a pin; and a pair of linkage members pivotally connected at one end to the flexible cover engaging member, engagable at their other end with said frame structure, and connected between their ends to each other by said pin, said pin being received within said track for displacement therein relative to said frame structure.

3. The adjustable chair as defined in claim 2, wherein said track defining member serves as stop for said flexible cover engaging member.

4. The adjustable chair as defined in claim 2, wherein the means for adjusting the relative position of the flexible cover engaging member further comprises: a slide control lever attached to each linkage member at their engagement with the frame structure for controlling the displacement of said pin within the track of the track defining member and the pivotal movement of a respective one of the linkage members about said pin.

5. The adjustable chair as defined in claim 4, wherein the frame structure includes a longitudinally arrayed plurality of laterally spaced slots within each of which a slide control lever is displaceably mounted.

6. The adjustable chair as defined in claim 5, wherein the means for adjusting the relative position of the flexible cover engaging member further comprises:

retaining means for retaining the slide control lever in its displaced position.

7. The adjustable chair as defined in claim 1, wherein the horizontal position of the seat structure is adjustable relative to the base structure.

8. The adjustable chair as defined in claim 1, wherein the vertical position of the back rest is adjustable relative to the seat structure.

9. The adjustable chair as defined in claim 1, wherein the vertical position of the back rest and seat structure are adjustable relative to the base structure.

10. The adjustable chair as defined in claim 1, wherein the back rest and the seat structure are mounted to be pivotable relative to each other and to the base structure.

* * * * *